US006588090B1

(12) United States Patent
Kendall et al.

(10) Patent No.: US 6,588,090 B1
(45) **Date of Patent: *Jul. 8, 2003**

(54) FABRICATION METHOD OF HIGH PRECISION, THERMALLY STABLE ELECTROMAGNETIC COIL VANES

(75) Inventors: Rodney A. Kendall, Ridgefield, CT (US); David A. Pickney, Danbury, CT (US)

(73) Assignee: Nikon Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 69 days.

(21) Appl. No.: 09/325,162

(22) Filed: Jun. 3, 1999

(51) Int. Cl.[7] ..... H01F 7/06

(52) U.S. Cl. ..... 29/602.1; 29/831; 29/825; 29/606; 427/116; 427/383.1; 205/118; 205/224

(58) Field of Search ..... 29/825, 604, 602.1, 29/592.1, 606, 831, 605; 205/220, 222, 223, 224, 118; 427/383.1, 383.3, 259, 116, 304, 96, 131, 132; 336/200; 303/119.3

(56) References Cited

U.S. PATENT DOCUMENTS

| | | | | | |
|---|---|---|---|---|---|
| 3,557,983 | A | * | 1/1971 | Hayes | 29/470.1 |
| 3,643,190 | A | * | 2/1972 | Puetz et al. | 335/132 |
| 4,342,143 | A | * | 8/1982 | Jennings | 29/25.42 |
| 4,369,557 | A | * | 1/1983 | Vandebult | 29/25.42 |
| 4,626,816 | A | * | 12/1986 | Blumkin et al. | 336/192 |
| 5,012,571 | A | * | 5/1991 | Fujita et al. | 29/598 |
| 5,237,165 | A | * | 8/1993 | Tingley, III | 235/492 |
| 5,341,555 | A | * | 8/1994 | Warden et al. | 29/496.5 |
| 5,363,081 | A | * | 11/1994 | Bando et al. | 336/200 |
| 5,402,098 | A | * | 3/1995 | Ohta et al. | 336/200 |
| 5,499,442 | A | * | 3/1996 | Nakamura et al. | 29/600 |
| 5,621,287 | A | * | 4/1997 | Dossot et al. | 315/399 |
| 5,652,561 | A | * | 7/1997 | Inoh et al. | 336/200 |
| 5,801,521 | A | * | 9/1998 | Mizoguchi et al. | 323/282 |
| 5,892,668 | A | * | 4/1999 | Okamoto et al. | 363/40 |
| 5,945,902 | A | * | 8/1999 | Lipkes et al. | 336/200 |
| 5,982,284 | A | * | 11/1999 | Baldwin et al. | 340/572.8 |
| 6,000,128 | A | * | 12/1999 | Umeno et al. | 29/846 |
| 6,144,269 | A | * | 11/2000 | Okamoto et al. | 333/184 |
| 6,153,885 | A | * | 11/2000 | Kendall | 250/396 ML |
| 6,189,200 | B1 | * | 2/2001 | Takeuchi et al. | 29/602.1 |

FOREIGN PATENT DOCUMENTS

| | | | | |
|---|---|---|---|---|
| JP | 403211804 | * | 9/1991 | 336/192 |
| JP | 5-198449 | * | 8/1993 | 29/602.1 |
| JP | 09330816 | * | 6/1996 | |

* cited by examiner

*Primary Examiner*—Peter Vo
*Assistant Examiner*—Minh Trinh
(74) *Attorney, Agent, or Firm*—Whitham, Curtis & Christofferson, P.C.

(57) ABSTRACT

The present invention relates to a method and apparatus of fabricating electromagnetic coil vanes. The method involves placing a bonding composition on opposing surfaces of a substrate. First and second complementary coil patterns are formed, and are aligned and bonded to respective clamp plate fixtures. The first complementary coil pattern is bonded to one surface of the opposing surfaces of the substrate via the bonding composition, and the second complementary coil pattern is bonded to the other surface of the opposing surfaces of the substrate via the bonding composition. The bonding composition is cured, and the clamp plates are removed from the first and second complementary coil patterns.

16 Claims, 10 Drawing Sheets

FABRICATION METHOD OF HIGH PRECISION, THERMALLY STABLE ELECTROMAGNETIC COIL VANES

CROSS-REFERENCE TO RELATED APPLICATION

This application is related to U.S. patent application Ser. No. 09/324,899, filed Jun. 3, 1999, now U.S. Pat. No. 6,153,885 issued Nov. 28, 2000 by Rodney, Kendall for-"Torroidal Charged particle Deflector With High Mechanical Stability and Accuracy" and assigned to a common assignee herewith. U.S. Pat. No. 6,153,885 is incorporated herein by reference.

DESCRIPTION

BACKGROUND OF THE INVENTION

1. Field of the Invention

The present invention generally relates to a method and apparatus of fabricating electromagnetic coil vanes and, more particularly, to a method and apparatus for fabricating high precision, thermally stable electromagnetic coil vanes used with Charged Particle Beam Projection Systems.

2. Background Description

Yokes and electromagnetic lenses are widely used in electron beam tools, electron microscopes, and cathode ray tubes. Yokes and lenses employing toroidal magnetic deflection coils are commonly used in electron beam lithography systems for focusing an electron beam on to a substrate for submicron patterning of semiconductor devices.

U.S. Pat. No. 4,251,728 to Pfeiffer shows an example of a toroidal magnetic deflection yoke. FIG. 1 shows a top view of a traditional toroidal yoke similar to that shown in Pfeiffer. The traditional yoke includes a plastic form having slots numbered from 1 to 20, and forms both X and Y coil axes.

Presently, electromagnetic coils are formed by winding wire into multiple radial grooves cut from a plastic form. Also, deflection yokes have been made from round wire, with bondable insulative coatings. The method used for winding the form to make the coils requires alternating between the X and the Y windings. As the number of radially cut grooves and the number of turns increases, so does the degree of difficulty and the time involved. Accordingly, current methods used for winding coils is difficult and time consuming, particularly when the number of offset grooves and turns increases.

SUMMARY OF THE INVENTION

It is therefore an object of the invention to provide a method and apparatus for fabricating high precision, thermally stable electromagnetic coil vanes.

According to the invention, a method and apparatus are provided to fabricate high current capacity, high accuracy, thermally stable deflection yokes used to generate off axis beam deflections.

In the preferred embodiment, electromagnetic coil vanes are fabricated having two complementary patterns of approximately 22–23 American Wire Gauge (AWG), uninsulated rectangular cross section wire to be accurately bonded to a thin substrate. Preferably, the coefficient of thermal expansion (CTE) of the thin substrate should be low. For example, quartz can be used, which has a CTE of approximately $0.56\times10^{-6}/°$ C. The two complementary copper coil patterns are connected by a through wire. The through wire provides an electrical connection between the two copper coil patterns. The gaps between adjacent copper wires must be as small as possible to maximize the copper density and thus the coil's effectiveness.

The method involves placing a bonding composition on opposing surfaces of a substrate. First and second complementary copper coil patterns are formed, aligned and bonded to respective clamp plate fixtures. The first complementary copper coil pattern is bonded to one surface of the opposing surfaces of the substrate via the bonding composition, and the second complementary copper coil pattern is bonded to the other surface of the opposing surfaces of the substrate via the bonding composition. The bonding composition is cured, and the clamp plates are removed from the first and second complementary copper coil patterns.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
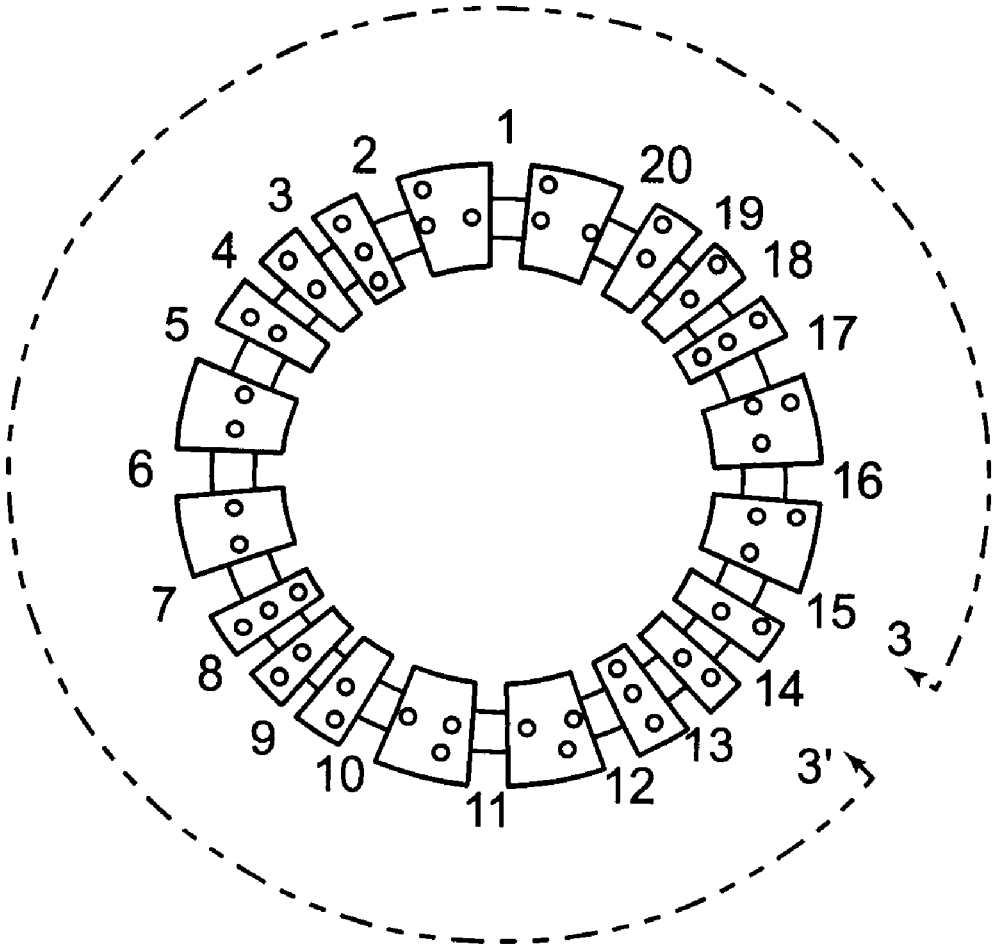
Figure 1 PRIOR ART
FIG. 1 shows a top view of a related art toroidal yoke.
Figure 2:
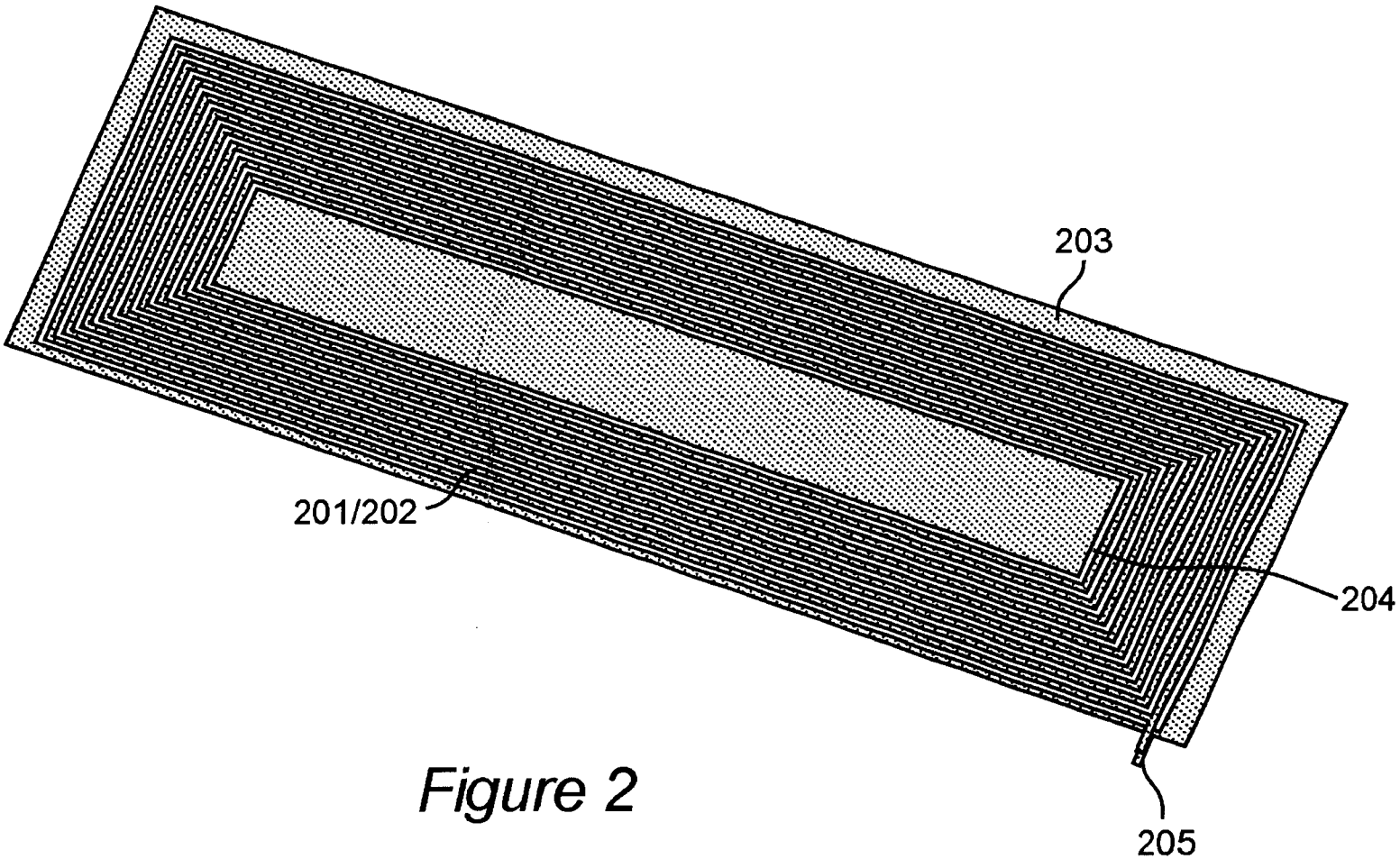
FIG. 2 shows an electromagnetic coil vane of the present invention.
Figure 3:
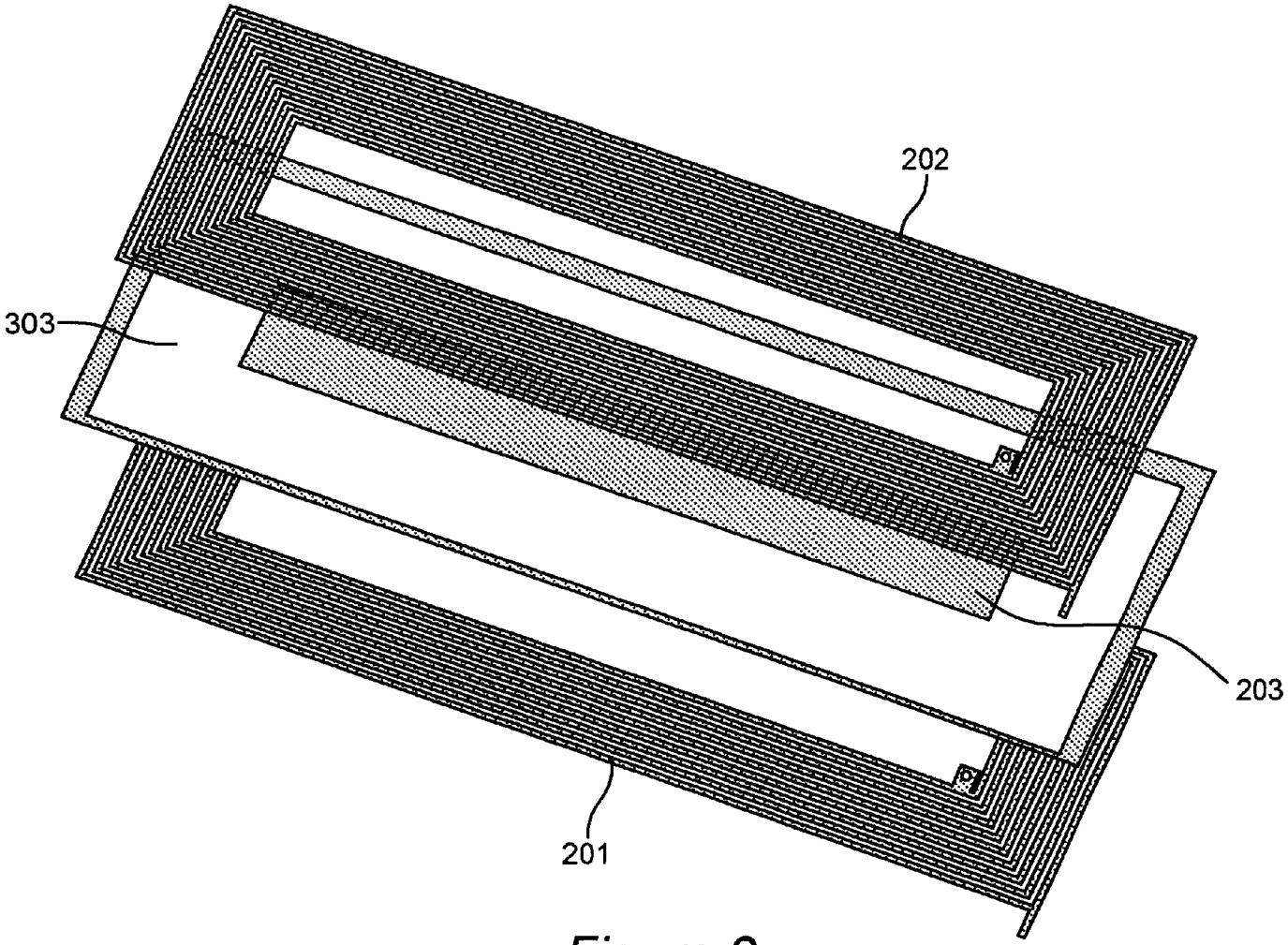
FIG. 3 shows assembly of a electromagnetic coil vane of the present invention.

Referring now to the drawings, and specifically to FIGS. 2 and 3, an electromagnetic coil vane is shown. In a preferred embodiment, the electromagnetic coil vane requires two complimentary copper coil patterns 201 and 202 of preferably approximately 22–23 AWG, uninsulated rectangular cross section wire. The complementary coil patterns 201 and 202 are then accurately bonded to opposing sides of a thin substrate 203. The substrate preferably has a low coefficient of thermal expansion (CTE). Other wires and substrates may also equally be used with the present invention, depending on the particular application. For example, Zerodur®, produced by Schott Glaswerke (Mainz, Germany) may also be used as a substrate. The two complementary copper coil patterns 201 and 202 are connected by a through wire 204. The through wire extends through substrate 203 and is connected to coils 201 and 202 to provide an electrical connection between them. The gaps between adjacent copper wires for patterns 201 and 202 must be as small as possible to maximize the copper density and thus the effectiveness of the coil. The termination wire 205 is a terminal portion of the coil wire where electric current is applied to the electromagnetic coil vane.

The electromagnetic coil vane, with complementary copper coil patterns 201 and 202, preferably are made from thin sheets of copper, via wire electrical discharge machining (EDM). Wire EDM enables many coils (preferably 50 or more) to be cut from stacked copper sheets, clamped together. The wire cross-section produced by this technique is rectangular with vertical sidewalls. The gaps between the adjacent wires are preferably small, with a preferred ratio of wire width to gap of approximately 2.5:1, or higher.

A bonding composition 303 such as a heat curable epoxy film is placed on the top and bottom surfaces of substrate 203. Other bonding compositions such as transfer adhesive films, two part room temperature epoxies, cyanoacrylates, and acrylic adhesives may also be used to practice the invention. The bonding composition 303 provides a thin, uniform bond line. Copper coil patterns 201 and 202 are then accurately aligned and bonded to the substrate 203 to form the electromagnetic coil vane.

Figure 4:
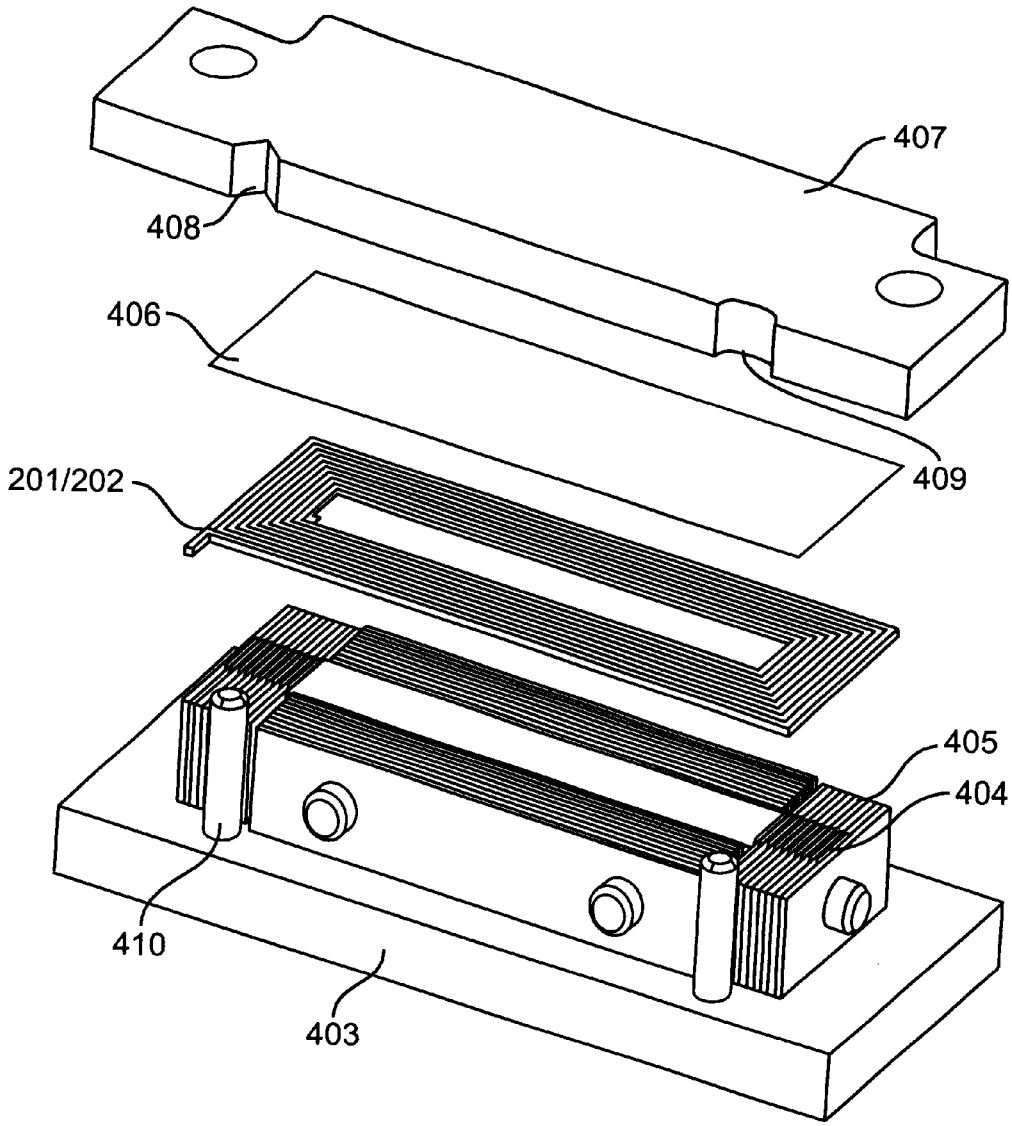
FIG. 4 shows a coil taping fixture of the present invention.

FIG. 4 shows an assembly of a coil vane taping fixture of the present invention. Following EDM fabrication, the individual copper coil patterns 201 and 202 are delicate and weak with little or no internal strength to maintain wire alignment. Accordingly, a coil taping fixture 403 provides a means to accurately align these copper coil patterns in preferred embodiments. The coil vane taping fixture has a"nest" on which either copper coil pattern 201 or 202 rests. Coil nest fingers 404, preferably made from thin sheet material, fit in the gaps between adjacent coil wires. The nest fingers do not rise up through the entire thickness of the copper coil. This enables copper tape 406 to be placed on the top surface of the copper coil. Nest spacers 405 set the spacing of the coil nest fingers 404 and provide the surface which supports the coil pattern.

Once copper coil pattern 201 or 202 is positioned in the coil taping fixture 403, copper tape 406 is placed on copper coil pattern 201 or 202. The CTE of copper tape 406 preferably matches the CTE of copper coil pattern 201 or 202. The copper tape 406 adheres to and maintains the alignment of the copper coil pattern 201 and 202 during and after coil pattern transfer to the clamping plate 407.

The transfer occurs as follows. An adhesive, preferably several drops of cyanoacrylate, is placed upon the copper tape 406 which is adhered to copper coil pattern 201 or 202. A clamp plate 407 with plate alignment notch 408 and alignment flat 409 is placed upon the adhesive. The plate alignment notch 408 positions the clamp plate in the horizontal plane, and plate alignment flat 409 positions clamp plate 409 with respect to an angular position within the horizontal plane. The plate alignment notch 408 and plate alignment flat 409 thus enable the clamp plate 407 to be accurately positioned with respect to clamp block alignment pins 410 on the coil taping fixture 403. These alignment features cause the copper coil pattern 201 or 202 to be accurately transferred to and positioned with respect to the clamp plate 407. This process is repeated so that both copper coil pattern 201 and its complementary copper coil pattern 202 are positioned on identical, individual clamp plates 407.

Figure 5:
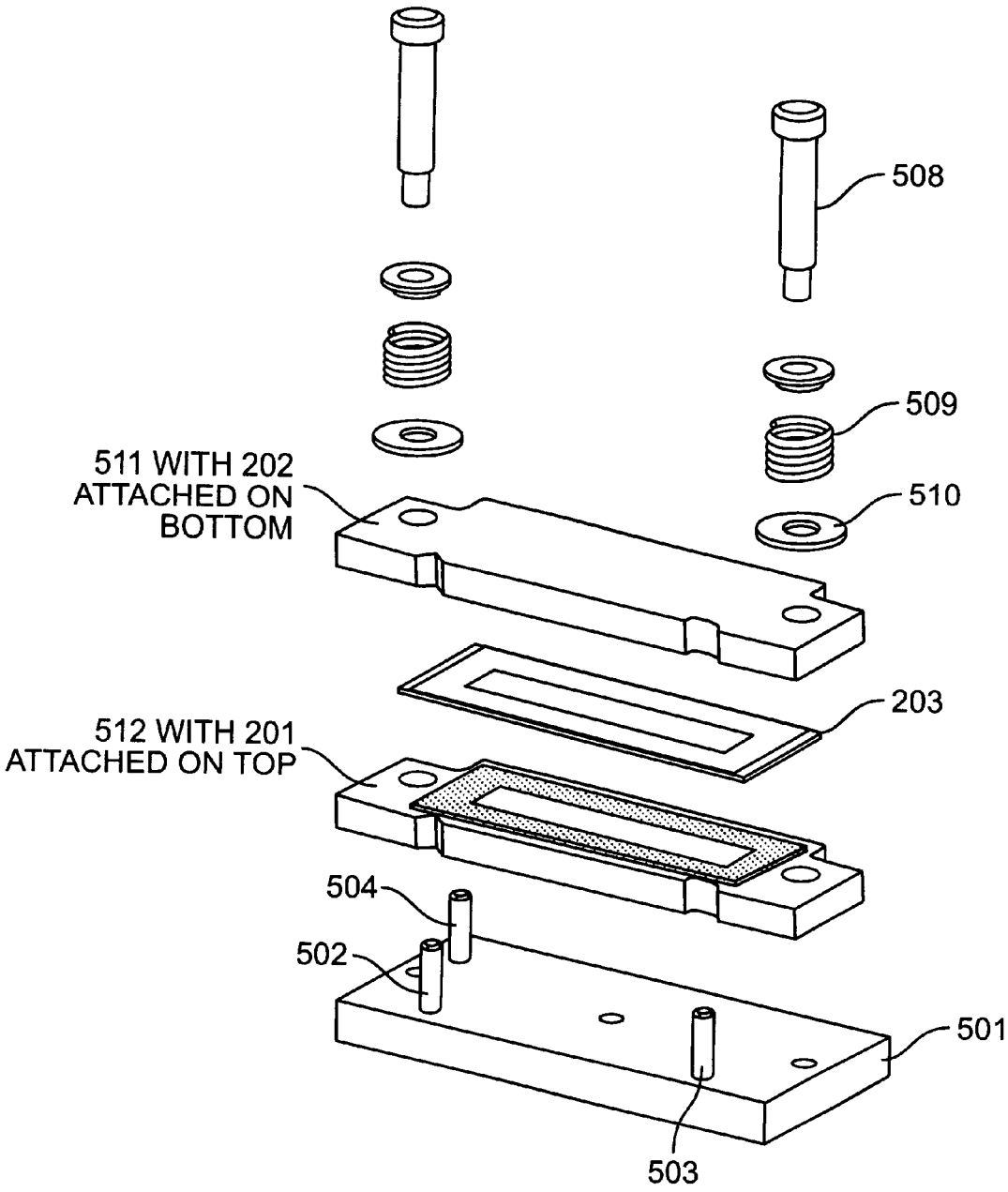
FIG. 5 shows an assembly of coil vane clamping fixture components of the present invention.

FIG. 5 shows the coil vane clamping fixture of the present invention. The coil vane clamping system of the present invention includes a clamp base 501 having three precision alignment pins 502, 503 and 504. Two of the pins, preferably 502, 503, are used to align the clamp plates 511, 512 to one another, and to align one edge of substrate 203 having bonding composition 303 on its top and bottom surfaces. The third pin 504 is preferably used to align a second edge of substrate 203.

In a preferred embodiment, copper coil pattern 201 is adhesively attached to a clamp plate 512, and copper coil pattern 202 is adhesively attached to a second clamp plate 511. The clamp plate 512 is placed and aligned to the clamp base 501. Next, substrate 203 having bonding composition 303 on its top and bottom surfaces is placed on top of copper coil pattern 201 and banked against the three pins 503, 504 and 505. It is preferred that the bonding composition 303 is applied to substrate 203 via a fixture (not shown) that facilitates positioning of. the bonding composition 303 onto the substrate 203. The clamp plate 511 (with coil pattern 202) is then placed on top of the substrate 203 and aligned to the clamp base 501. The assembly is held together by two shoulder screws 508, two compression springs 509, and spacers 510. The compression springs 509 provide a substantially uniform clamp pressure across clamp plates 512 and 511 and the substrate 203.

Figure 6:
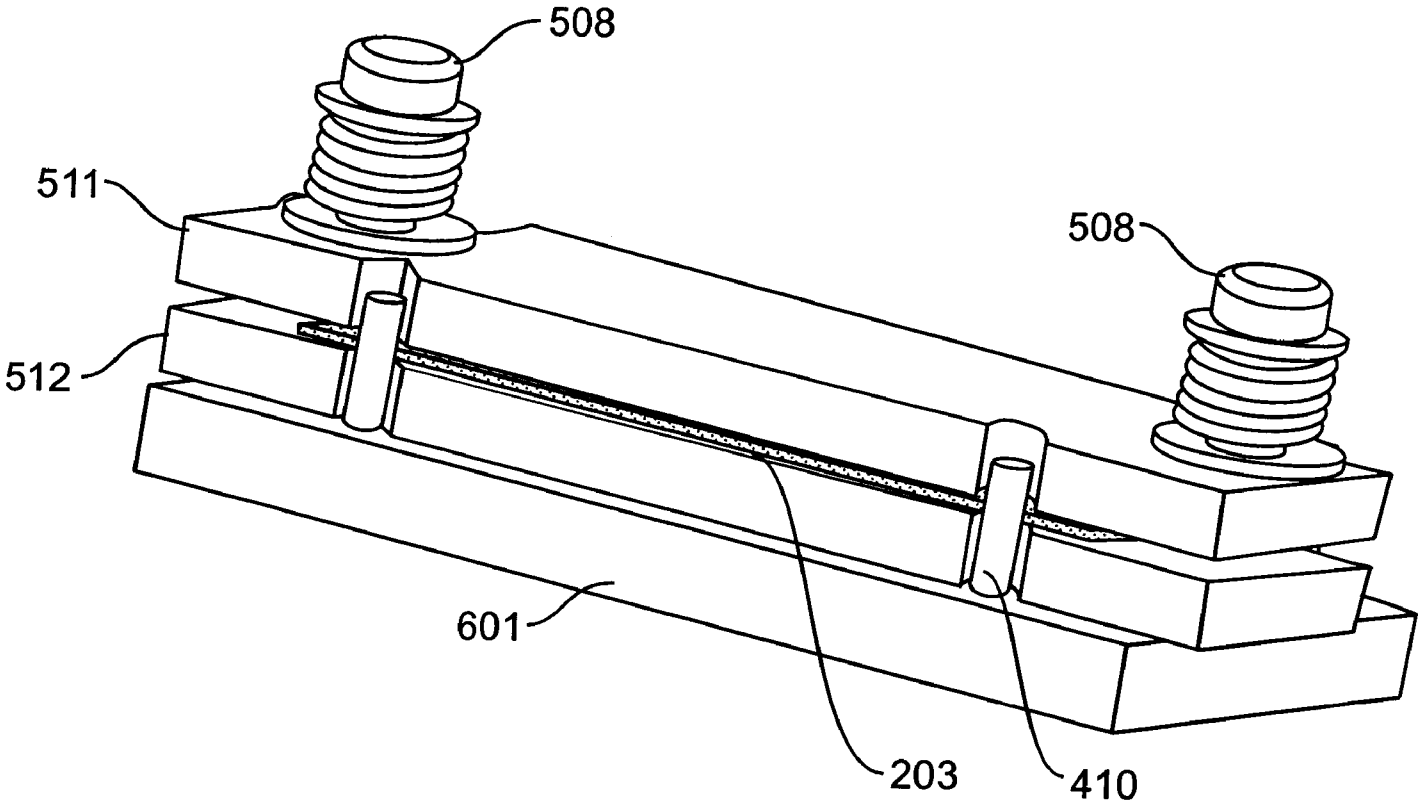
FIG. 6 shows a coil vane clamping fixture assembly of the present invention.

Once together, the clamp fixture assembly appears as shown in FIG. 6. The clamp assembly 601 is then placed in an oven to enable the bonding composition 303 to cure and bond copper coil patterns 201 and 202 to the substrate 203. After curing, the shoulder screws 508 are removed from clamp fixture 601. Clamp plates 511 and 512 are removed from substrate 203, and the copper tape 406 is peeled off the coils 201 and 202.

Figure 7:
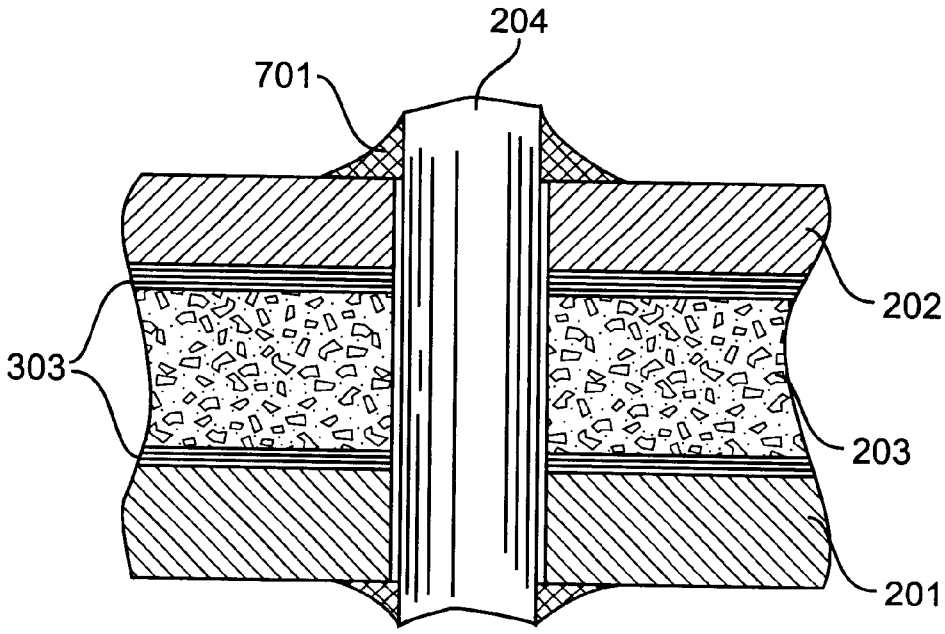
FIG. 7 shows a through wire that connects the two coil patterns through the substrate.

As shown in FIG. 7, through wire 204 is placed in a pre-drilled hole of the substrate 203. The through wire 204 electrically connects coil pattern 201 and coil pattern 202. Solder 701 is used to secure and electrically connect the through wire 204 to coil pattern 201 and coil pattern 202. The completed electromagnetic coil vane as shown in FIG. 2 is thus provided.

Figure 8:
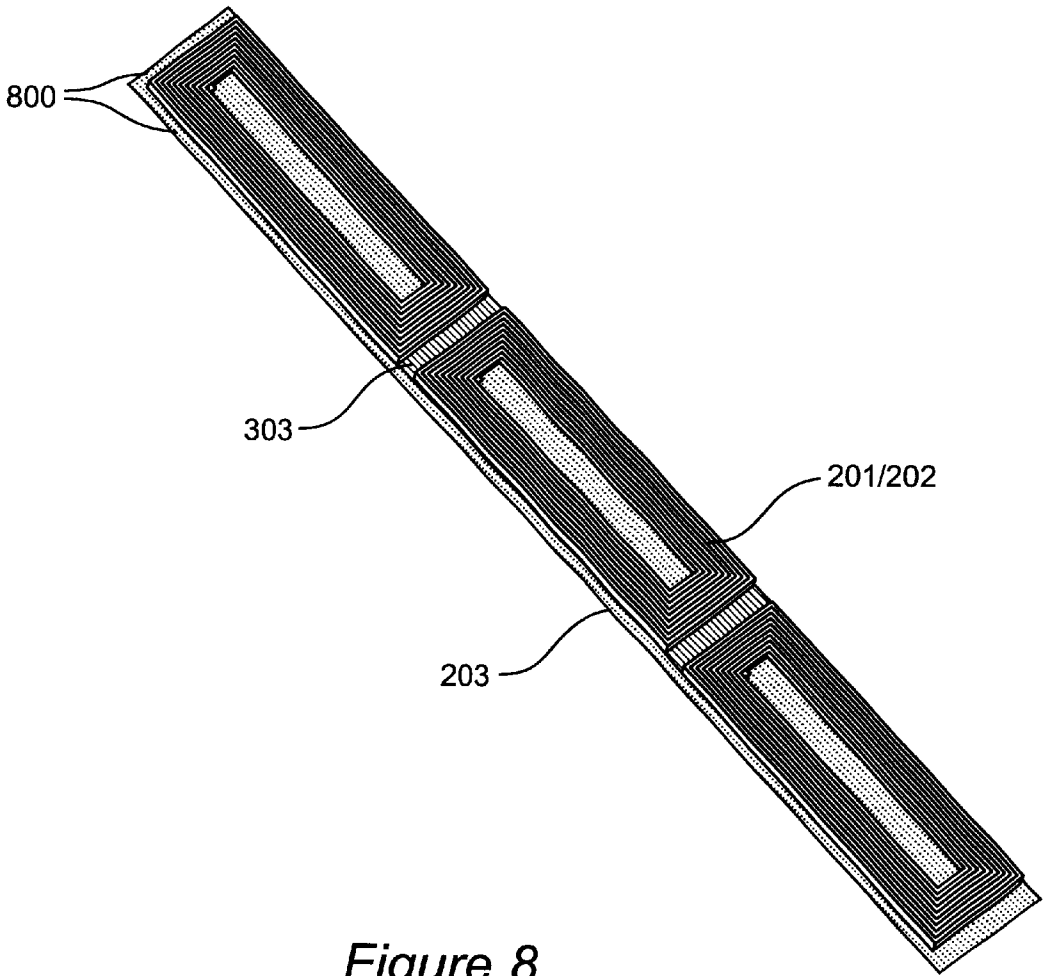
FIG. 8 shows three electromagnetic coil vanes of the present invention.

In view of the foregoing, it is seen that the invention provides a method and apparatus for fabricating high precision, thermally stable electromagnetic coil vanes. This meritorious effect of the invention will also be produced in variations of the invention. For example, as shown in FIG. 8, the invention can also be practiced by providing a plurality of coil patterns 201 and 202 on each side of substrate 203. Reference edges 800 are used for mounting the substrate to the taping fixture and clamping fixture shown in FIGS. 9 and 10, respectively.

Figure 9:
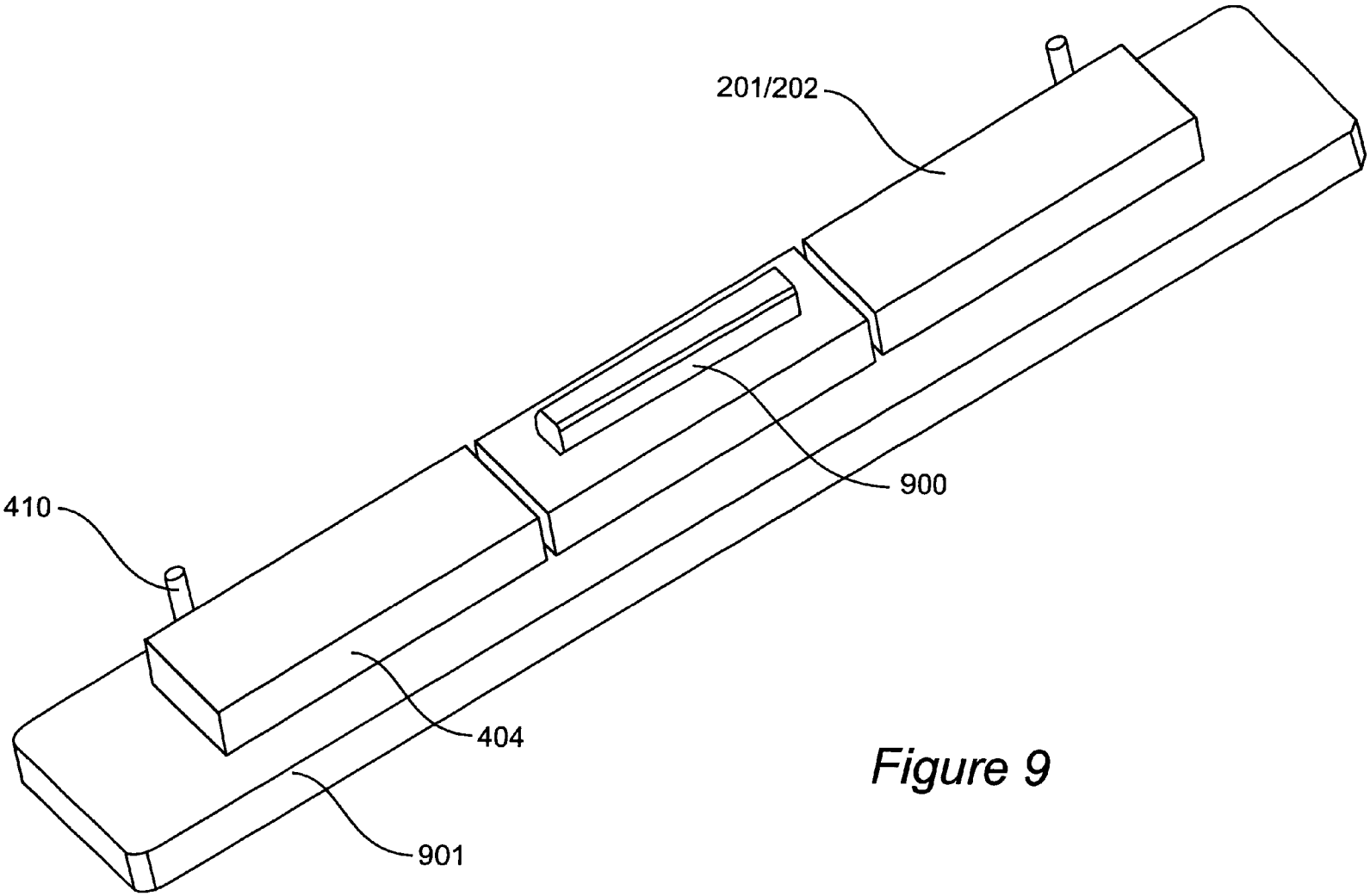
FIG. 9 shows a coil taping fixture used to tape three coil vanes of the present invention.

FIG. 9 shows an embodiment of a coil taping fixture for three coil vanes on substrate 203. As such, the taping fixture is similar to the taping fixture shown in FIG. 4. Coil taping fixture 901 utilizes a pre-aligner 900 for aligning substrate 203 with respect to alignment pins 410.

Figure 10:
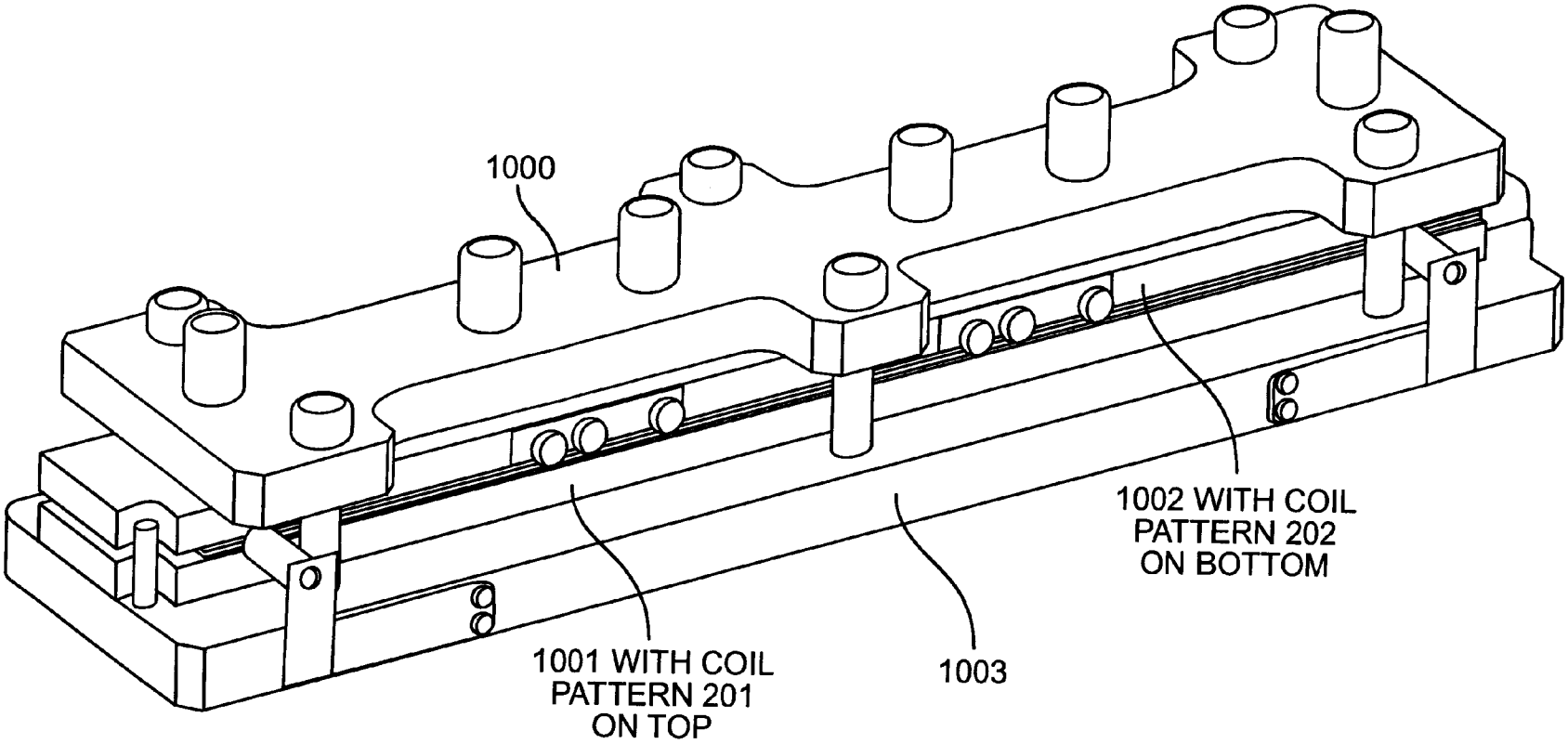
FIG. 10 shows a coil vane clamping fixture assembly of the present invention.

FIG. 10 shows a coil vane clamping fixture assembly for three coil vanes on substrate 203. Similar to the clamping fixture shown in FIG. 5, the clamping fixture shown in FIG. 10 includes a clamp plate 1001 with coil patterns 201 on the top surface thereof, clamp plate 1002 with coil pattern 202 on the bottom surface thereof, and means for aligning clamp plates 1001 and 1002 with respect to the clamp base assembly 1003. Spring plate assembly 1000 is used to apply pressure to clamp plates 1001 and 1002.

While the invention has been described in terms of preferred embodiments, those skilled in the art will recognize that the invention can be practiced with modification within the spirit and scope of the appended claims.

Having thus described our invention, what we claim as new and desire to secure by Letters Patent is as follows:

1. A method for fabricating high-precision, thermally stable electromagnetic coil vanes, comprising the steps of:

forming first and second coil pattern elements of substantially the same size and shape; and aligning and bonding the first and second coil pattern elements to respective first and second surfaces, of a substrate having a low coefficient of thermal expansion using a bonding composition contacting the substrate and a surface of each of said first and second coil pattern elements facing said substrate wherein the first and second coil pattern elements are positioned at substantially corresponding locations with respect to each other on the first and second surfaces of the substrate.

2. The method as recited in claim 1, wherein the first and second coil pattern elements have a ratio of wire width to gap of at least 2.5:1.

3. The method as recited in claim 1, wherein the substrate has the coefficient of thermal expansion of approximately $0.56\times10^{-6}/°$ C.

4. The method as recited in claim 1, wherein the substrate is quartz.

5. The method as recited in claim 1, wherein the bonding composition is thermagon, a heat curable bonding composition that cures without thermal deformation.

6. The method for fabricating high precision, thermally stable electromagnetic coil vanes, according to claim 1, further comprising the steps of:

forming third, fourth, fifth and sixth complementary coil pattern elements;

aligning and bonding the third, fourth, fifth and sixth complementary coil pattern elements to the substrate, wherein the third and fourth, and fifth and sixth coil pattern elements are positioned at substantially the same locations with respect to each other on the one the one surface and the other surface of the substrate, respectively; and curing the bonding composition on the opposing surfaces of the substrate to each coil pattern element.

7. The method as recited in claim 1, wherein the steps of aligning and bonding the first and second coil pattern elements comprises the steps of:

extending a material into gaps of the first and second coil pattern elements to maintain a substantially uniform spacing of wires of the first and second coil pattern elements;

placing a tape upon the first and second coil pattern elements to enable the spacing of the first and second coil pattern elements to be adhesively maintained;

adhering the first coil pattern element to the first surface of the substrate, wherein the tape is affixed to the first coil pattern element;

adhering the second coil pattern element relative to the second surface of the substrate, wherein the tape is affixed to the second coil pattern element, and wherein the first and second coil pattern elements are positioned at substantially the same locations with respect to each other on the first and second surfaces of the substrate, respectively; and clamping the first and second coil pattern elements and the substrate.

8. The method as recited in claim 7, further comprising the step of heating the first and second coil pattern elements and the substrate to enable the bonding composition to cure and bond the first and second coil pattern elements to the substrate.

9. The method as recited in claim 7, wherein the material is sheet metal.

10. The method as recited in claim 7, wherein the at least one of the aligning steps comprises the step of aligning a clamp plate with respect to a coil taping fixture.

11. The method as recited in claim 1, further comprising the step of removing the tape from the first and second coil pattern elements subsequent to said clamping step.

12. The method as recited in claim 5, wherein the tape is copper tape.

13. The method as recited in claim 12, wherein at least one of the aligning steps comprises the step of aligning the clamp plate to a clamp base.

14. The method as recited in claim 13, wherein at least one of the aligning steps further comprises the step of securing the clamp plate to the clamp base by a plurality of shoulder screws.

15. The method as recited in claim 14, wherein at least one of the aligning and bonding steps further comprises the step of positioning a spring between the shoulder screws and the clamp plate.

16. The method as recited in claim 15, herein the end spaces of each spring contact a spacer.

* * * * *